US006546779B2

(12) United States Patent
Oliver

(10) Patent No.: US 6,546,779 B2
(45) Date of Patent: Apr. 15, 2003

(54) EYELET SIZING TOOL FOR A NEEDLE/ ARMATURE ROTATION LIMITING FEATURE OF A FUEL INJECTOR

(75) Inventor: Jack David Oliver, Williamsburg, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/893,507

(22) Filed: Jun. 29, 2001

(65) Prior Publication Data

US 2003/0000280 A1 Jan. 2, 2003

(51) Int. Cl.[7] ..... B21D 39/06
(52) U.S. Cl. ..... 72/370.07; 72/479; 29/523
(58) Field of Search ..... 239/585.5; 29/523; 72/370.07, 393, 479

(56) References Cited

U.S. PATENT DOCUMENTS 3,017,793 A * 1/1962 Appel ..... 72/479
4,262,271 A * 4/1981 Bowers et al. ..... 335/263
4,331,317 A * 5/1982 Kamai et al. ..... 251/139
4,382,554 A * 5/1983 Hofmann ..... 239/533.9
4,394,964 A * 7/1983 Ecomard et al. ..... 239/90
4,679,017 A * 7/1987 Mishler et al. ..... 335/164
4,701,993 A * 10/1987 Bradley et al. ..... 29/523
4,771,627 A * 9/1988 Speakman ..... 72/479
4,871,989 A * 10/1989 Gross ..... 335/164
4,934,170 A * 6/1990 Easterbrook et al. ..... 72/393
5,127,584 A * 7/1992 Sczomak ..... 239/533.1
5,875,972 A * 3/1999 Ren et al. ..... 239/463
6,199,539 B1 * 3/2001 Pearlman et al. ..... 123/470
6,227,457 B1 * 5/2001 Oliver ..... 239/5

OTHER PUBLICATIONS

Patent Appln. No. 09/770,980, Jack D. Oliver, filed Jan. 26, 2001, pending.*

* cited by examiner

*Primary Examiner*—Lowell A. Larson

(57) ABSTRACT

A tool for forming an armature guide eyelet. The tool having a body with a working end, a support end and at least one sizing rib disposed along a longitudinal axis. The at least one sizing rib has a perimeter having a first portion and a second portion. The first portion has a substantially constant distance $D_c$, from the longitudinal axis. The second portion has a varying distance $D_v$ from the longitudinal axis. Also, a method for forming the armature guide eyelet with the tool. The method including aligning at least one non-uniform sizing rib and an armature guide eyelet having a constant inner diameter along a longitudinal axis and forming the constant inner diameter of the armature guide eyelet into a non-uniform inner diameter with the at least one non-uniform sizing rib.

21 Claims, 3 Drawing Sheets

EYELET SIZING TOOL FOR A NEEDLE/ ARMATURE ROTATION LIMITING FEATURE OF A FUEL INJECTOR

FIELD OF THE INVENTION

This invention relates to forming tools and more particularly to a tool for forming an armature guide eyelet disposed in a solenoid actuated fuel injector with a feature that limits rotation of the closure assembly of the fuel injector.

BACKGROUND OF THE INVENTION

It is believed that tools exist for forming the inside diameter of an armature guide eyelet. The armature guide eyelet that is disposed in a fuel injector, is such an eyelet. These tools form a uniform inner diameter of the armature guide eyelet. The uniform inner diameter fails to limit rotation of the closure assembly within the fuel injector.

It would be beneficial to provide a tool to form a non-uniform armature guide eyelet for use in a fuel injector to limit rotation of a closure assembly of the fuel injector.

BRIEF SUMMARY OF THE INVENTION

The present invention provides a tool for forming an armature guide eyelet. The armature guide eyelet that is formed by the tool is disposed in a solenoid actuated fuel injector to limit relative rotation between the closure member and its support member. The tool preferably includes a body having a working end, a support end and at least one sizing rib disposed along a longitudinal axis. The at least one sizing rib has a perimeter with a first portion and a second portion. The first portion has a substantially constant distance $D_c$ from the longitudinal axis. The second portion has a varying distance $D_v$ from the longitudinal axis.

Further, the present invention also provides a method of forming an armature guide eyelet to be used in a solenoid actuated fuel injector. The method can be achieved by aligning at least one non-uniform sizing rib and an armature guide eyelet having a constant inner diameter along a longitudinal axis, and forming the constant inner diameter of the armature guide eyelet into a non-uniform inner diameter with the at least one non-uniform sizing rib.

BRIEF DESCRIPTION OF THE DRAWINGS

The accompanying drawings, which are incorporated herein, and constitute part of this specification, illustrate the presently preferred embodiments of the invention, and, together with the general description given above and the detailed description given below, serve to explain the features of the invention. In the drawings.

DETAILED DESCRIPTION OF THE PREFERRED EMBODIMENTS

Figure 1:
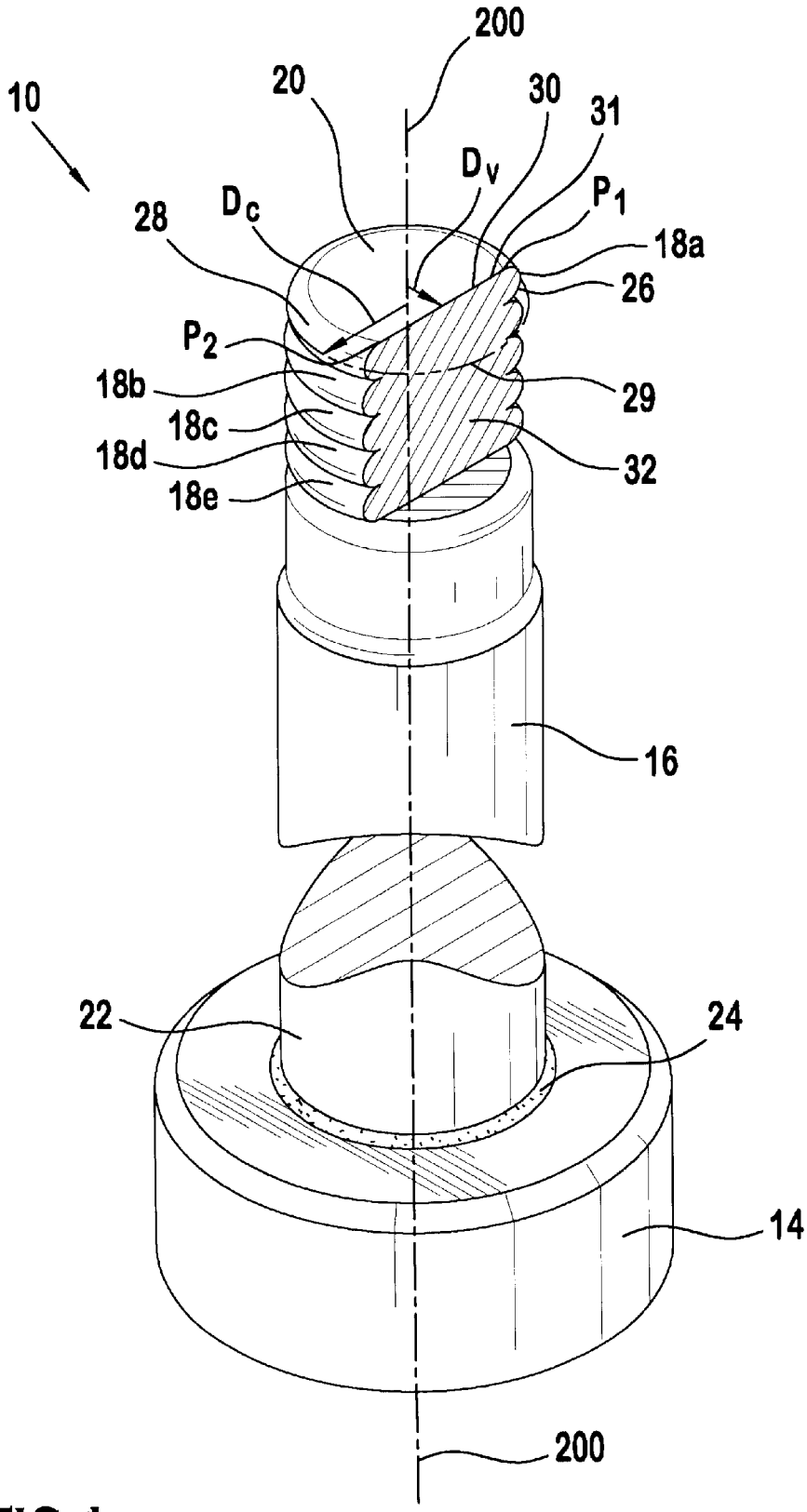
FIG. 1 is a perspective view of the forming tool of a preformed embodiment.

FIG. 1 illustrates a tool 10 according to a preferred embodiment. The tool 10 is used to form an armature guide eyelet with non-uniform surfaces of contact. The preferred embodiment of the tool 10 provides a method of forming the armature guide eyelet with the tool 10. Multiple embodiments of the tool 10 can be employed to achieve different embodiments of the armature guide eyelet. The different embodiments of the armature guide eyelet may be used in a fuel injector with a rotation limiting feature, as disclosed in commonly owned U.S. patent application Ser. No. 09/770,980, filed Jan. 26, 2001, which is incorporated herein by reference in its entirety.

A fuel injector (not shown) with the rotation limiting feature preferably has an armature guide eyelet and a closure member, which is preferably, a needle/armature assembly. The armature guide eyelet and needle/armature assembly are disposed along a longitudinal axis. The armature guide eyelet and the needle/armature assembly have mating non-uniform surfaces of contact. The mating of non-uniform surfaces of contact limits rotation of the needle/armature assembly within the fuel injector.

The tool 10 has a base 14 and a body 16. The body 14 has a working end 20, a support end 22 and at least one sizing rib 18 which are disposed along a longitudinal axis 200. The shape of the base 14 and body 16 are preferably cylindrical. However, the base 14 and the body 16 may both or independently be configured as a square, rectangular, hexagonal, triangular, or any other geometric shape. The base 14 is coupled to the support end 22 of the body 16. The base 14 and body 16 are coupled by puddle brazing 24. Other methods for coupling the base 14 and the body 16 can be employed for example, welding, the use of adhesives and friction fitting so long as the base 14 is second to the body 16 such that movement of the base 14 results on relative movement of the body 16. The base 14 is preferably fabricated from AISI A-2 60–62 Rc steel. The body 16 is preferably fabricated from CD 35F carbide. Other materials, such as for example tool steel, may be used to fabricate both or one of the base 14 and body 16.

The at least one sizing rib 18 has a perimeter 26 that is disposed about the longitudinal axis 200. The perimeter 26 has a first portion 28 and a second portion 30. The first portion 28 of the perimeter 26 is disposed on an imaginary circle 29 that surrounds the longitudinal axis 200. The first portion 28 of the perimeter 26 has a substantially constant distance $D_c$ that extends from the longitudinal axis 200. The second portion 30 of the perimeter 26 has a varying distance $D_v$ that extends from the longitudinal axis 200. In the embodiment of FIG. 1, the varying distance $D_v$ is less than the constant distance $D_c$.

The second portion 30 of the perimeter 26 has a sector 31. The sector 31 cuts through the imaginary circle 29 at two points P1 and P2. The sector 31 is tangent to the imaginary circle 29 and parallel to the longitudinal axis 200. The sector 31 creates a flat portion 32 that extends through the at least one sizing rib 18. The at least one sizing rib 18 may provide as a plurality of sizing ribs 18*a*, 18*b*, 18*c*, 18*d* and 18*e*. The flat portion 32 may be formed in a variety of ways. In one embodiment, the flat portion 32 is ground into the plurality of sizing ribs 18*a*–18*e*. In a further embodiment, the flat portion 32 is machined into the plurality of sizing ribs 18*a*–18*e*. It should be recognized by those skilled in the art other techniques may be employed to form that the flat portion 32, such as for example, forged, molded and cast.

The varying distance $D_v$ of the second portion 30 may be varied to create other embodiments of tool 10 as well. For example, in one embodiment, the varying distance $D_v$ may be configured such that the second portion 30 bows outward away from the longitudinal axis 200. In this embodiment, the varying distance $D_v$ from the longitudinal axis 200 to the second portion 30 of the at least one sizing rib 18 is greater than the constant distance $D_c$ from the longitudinal axis 200 to the first portion 28 of the at least one sizing rib 18.

In a further embodiment, the varying distance $D_v$ may be configured so that the second portion 30 bows inward, toward the longitudinal axis 200. As was the case with the embodiment of FIG. 1, the varying distance $D_v$ from the longitudinal axis 200 to the second portion 30 of the at least one sizing rib 18 is less than the constant distance $D_c$ from the longitudinal axis 200 to the first portion 30 of the at least one sizing rib 18.

In other embodiments, the constant distance $D_c$ of the first portion 28 may include multiple areas of constant distance. Examples of such multiple areas of constant distance $D_c$ of the first portion 28 may include triangular, star and hexagonal configurations. When the multiple areas of constant distance is mated with a similarly shaped needle/armature, the multiple mated areas of constant distance $D_c$ act to limit rotation.

Figure 2:
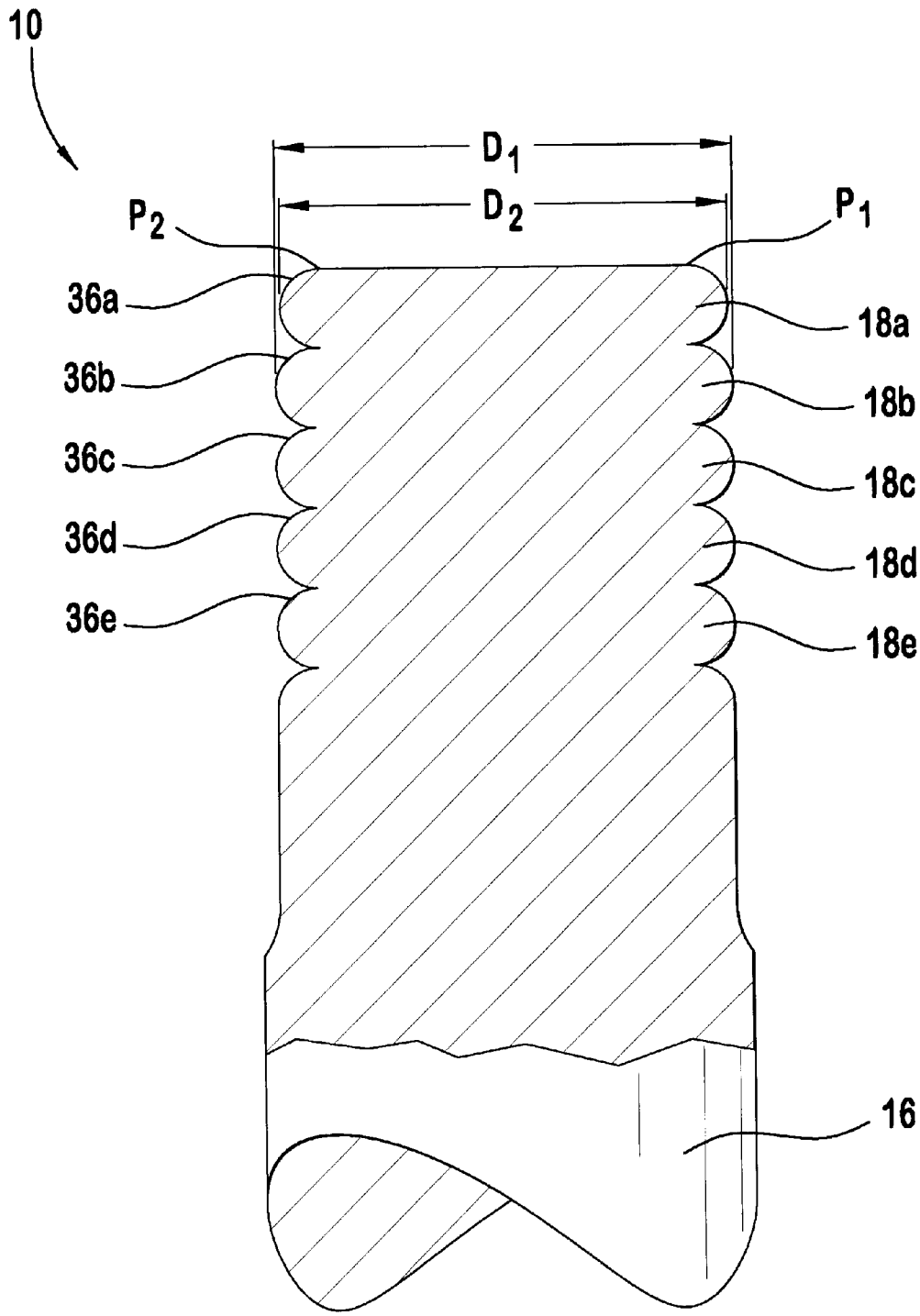
FIG. 2 is a cross-sectional view of the forming tool of FIG. 1.

A cross-section of the body 16 of the tool 10 is shown in FIG. 2. Each of the plurality of sizing ribs 18*a*–18*e* has a corresponding one of a plurality of outer surfaces 36*a*–36*e*. Each of the plurality of outer surfaces 36*a*–36*e* are configured to be convex with respect to the longitudinal axis 200. Sizing rib 18*a* with corresponding outer surface 36*a* may provide an entry sizing rib. Sizing ribs 18*b*–18*e* with corresponding outer surfaces 36*b*–36*e* may provide a plurality of finishing sizing ribs. The entry sizing rib 18*a* has a first diameter $D_1$ and the plurality of finishing sizing ribs 18*b*–18*e* have a second diameter $D_2$. The first diameter $D_1$ of the entry sizing rib 18*a* is preferably smaller than second diameter $D_2$ of the plurality of finishing sizing ribs 18*b*–18*e*. The entry sizing rib 18*a* is disposed at an outer end 40 of the working end 20 of the body 16.

A method of forming an armature guide eyelet 12 with the tool 10 of the preferred embodiment will now be described. The method may be achieved by aligning the tool 10 with the armature guide eyelet 12 along the longitudinal axis 200. The eyelet 12 configured for operation by the tool 10 of the preferred embodiment has a constant inner diameter 42. The plurality of sizing ribs 18*a*–18*e* of the tool 10 are driven through the constant inner diameter 42 of the armature guide eyelet 12. The entry sizing rib 18*a* makes first contact with the constant inner diameter 42 of the armature guide eyelet 12. The plurality of finishing sizing ribs 18*b*–18*e* make second and final contact. Since the entry sizing rib 18*a* is slightly smaller in diameter $D_1$ than the diameter $D_2$ of the plurality of finishing ribs 18*b*–18*e* the sizing of the armature guide eyelet 12 made by the initial penetration of the entry sizing rib 18*a* is not complete. The plurality of finishing sizing ribs 18*b*–18*e* form and establish the final size of the inner diameter of the armature guide eyelet 12. Since the forming tool 10 is non-uniform in shape, for example, the flat 32 cuts through the plurality of sizing ribs 18*a*–18*e*, the result of driving the sizing ribs 18*a*–18*e* through the armature guide eyelet 12 forms an armature guide eyelet 12 with a non-uniform inner diameter 44.

Figure 3:
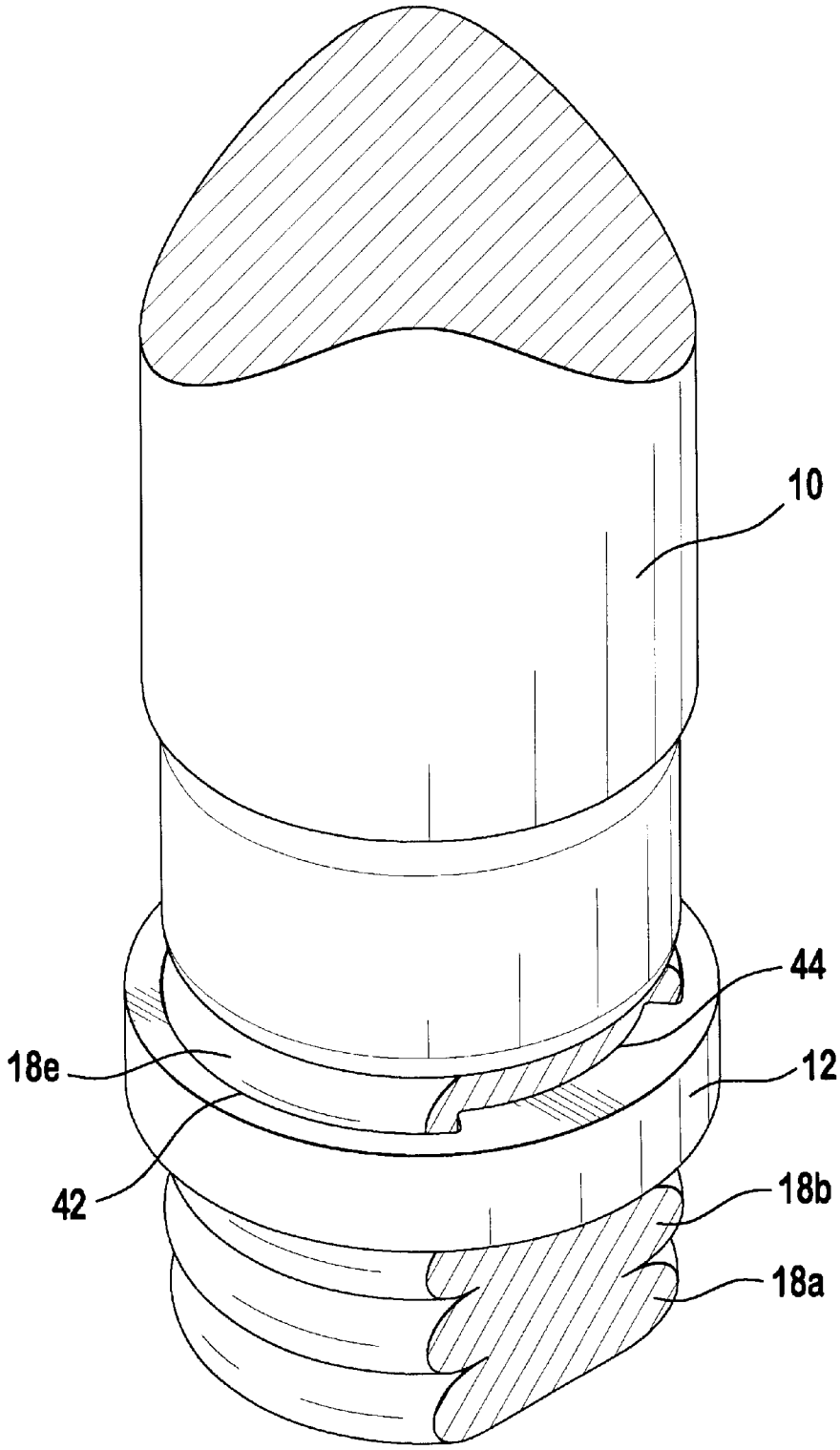
FIG. 3 is a perspective view of the tool of FIG. 1 & FIG. 2 performing an operation on an armature guide eyelet.

FIG. 3 shows the preferred embodiment of non-uniform tool 10 and the resultant shape of the armature guide eyelet 12 with the non-uniform diameter 44. An alternate embodiment of an armature guide eyelet 12 may be formed with the previously described embodiment of the forming tool 10 wherein the varying distance $D_v$ of the second portion 30 of the perimeter 26 bows outward away from the longitudinal axis 200.

It will be appreciated by those skilled in the art that changes could be made to the embodiments of the tool 10 described above without departing from the broad inventive concept thereof. It is understood, therefore, that this invention is not limited to the particular embodiments disclosed, but is intended to cover modifications within the spirit and scope of the present invention as defined in the appended claims.

What is claimed is:

1. A tool for forming an armature guide eyelet, the armature guide eyelet being disposed in a solenoid actuated fuel injector, the tool comprising:

a body having a working end, a support end and at least one sizing rib disposed along a longitudinal axis; and wherein the at least on sizing rib comprises a perimeter, the perimeter including a first portion and a second portion, the first portion having a substantially constant distance $D_c$ from the longitudinal axis, the second potion having a varying distance $D_v$ from the longitudinal axis.

2. The tool according to claim 1 wherein the distance from the longitudinal axis to the second portion of the at least one sizing rib is less than the distance from the longitudinal axis to the first portion of the at least one sizing rib.

3. The tool according to claim 1 further comprising a base extending along the longitudinal axis and coupled to the support end of the body.

4. The tool according to claim 3 wherein the base comprises a cylindrical member.

5. The tool according to claim 1 wherein the body comprises a cylindrical member.

6. The tool according to claim 1 wherein an outer surface of the at least one sizing rib is convex.

7. The tool according to claim 1 wherein the constant distance of the first portion may comprise multiple areas of constant distance.

8. The tool according to claim 1 wherein the first portion of the perimeter is disposed on an imaginary circle that surrounds the longitudinal axis.

9. The tool according to claim 8 wherein the second portion comprises a sector cutting a section of the imaginary circle at two points, the sector tangent to the imaginary circle and parallel to the longitudinal axis.

10. The tool according to claim 1 wherein the at least one sizing rib comprises two or more sizing ribs.

11. The tool according to claim 10 wherein the at least two or more sizing ribs comprise an entry sizing rib and a plurality of finishing sizing ribs, the entry sizing rib having a first diameter, the plurality of finishing sizing ribs having a second diameter.

12. The tool according to claim 11 wherein the entry sizing rib having the first diameter is smaller than the plurality of finishing sizing ribs with the second diameter.

13. The tool according to claim 12 wherein the entry sizing rib is disposed at an outer end of the working end.

14. A tool for forming an armature guide eyelet, the armature guide eyelet being disposed in a solenoid actuated fuel injector, the tool comprising:

a body having a first end and a second end disposed along a longitudinal axis;

at least one sizing rib disposed on an imaginary circle that surrounds the longitudinal axis, the at least on sizing rib having a first potion and a second portion, the first portion having a constant radius from the longitudinal axis, the second potion having a sector cutting a section of the imaginary circle at two points, the sector tangent to the imaginary circle and parallel to the longitudinal axis.

15. The tool according to claim 14 wherein the at least one sizing rib comprises a plurality of sizing ribs.

16. The tool according to claim 15 wherein the plurality of sizing ribs comprise an entry sizing rib and a plurality of finishing sizing ribs, the entry sizing rib having a first diameter, the plurality of finishing sizing ribs having a second diameter.

17. A method of forming an armature guide eyelet to be used in a solenoid actuated fuel injector, the armature guide eyelet being supported in a fixture, the method comprising;

aligning at least one non-uniform sizing rib and an armature guide eyelet having a constant inner diameter along a longitudinal axis; and forming the constant inner diameter of the armature guide eyelet into a non-uniform inner diameter with the at least one non-uniform sizing rib.

18. The method according to claim 17 wherein aligning the at least one sizing rib further comprises a body, the body having a working end and a support end disposed along the longitudinal axis.

19. The method according to claim 17 wherein aligning the at least on sizing rib further comprises a perimeter, the perimeter including a first potion and a second portion, the first portion having a substantially constant distance $D_c$ from the longitudinal axis, the second potion having a varying distance $D_v$ from the longitudinal axis.

20. The method according to claim 17 wherein aligning the at least one sizing rib further comprises two or more sizing ribs.

21. The method according to claim 20 wherein aligning the two or more sizing ribs further comprise an entry sizing rib and a plurality of finishing sizing ribs, the entry sizing rib having a first diameter, the finishing sizing ribs having a second diameter.

* * * * *